US009259045B1

(12) United States Patent
Yanes et al.

(10) Patent No.: US 9,259,045 B1
(45) Date of Patent: Feb. 16, 2016

(54) PINNED PLATE ASSEMBLY

(71) Applicants: Daniel Francisco Yanes, Miami, FL (US); Miguel Angel Yanes, Miami, FL (US); Isabelie Yanes, Miami, FL (US)

(72) Inventors: Daniel Francisco Yanes, Miami, FL (US); Miguel Angel Yanes, Miami, FL (US); Isabelie Yanes, Miami, FL (US)

( * ) Notice: Subject to any disclaimer, the term of this patent is extended or adjusted under 35 U.S.C. 154(b) by 70 days.

(21) Appl. No.: 14/256,322

(22) Filed: Apr. 18, 2014

(51) Int. Cl.
*G09F 3/00* (2006.01)
*A42B 1/00* (2006.01)
*A44C 3/00* (2006.01)

(52) U.S. Cl.
CPC ..... *A42B 1/004* (2013.01); *A44C 3/001* (2013.01)

(58) Field of Classification Search
CPC ..... A44C 3/001
USPC ..... 40/1.5, 1.6, 329, 586, 661.04; 24/114.2, 24/114.12, 113 R; 248/481
See application file for complete search history.

(56) References Cited

U.S. PATENT DOCUMENTS 3,735,447 A 5/1973 Abraham
4,632,348 A * 12/1986 Keesling ..... F16C 11/0619 248/222.11
5,276,985 A * 1/1994 Halloran ..... A42B 1/248 2/209.13
5,813,153 A * 9/1998 Maglio ..... G09F 3/02 283/2
6,122,805 A 9/2000 Haegley
6,132,051 A * 10/2000 Morell ..... B60R 1/081 248/476
6,178,680 B1 1/2001 Sloot
6,675,512 B1 1/2004 Shwartz et al.
6,701,649 B1 3/2004 Brosi
D558,955 S 1/2008 Taylor
D603,584 S 11/2009 Porter
7,640,636 B2 1/2010 Clark
8,001,661 B2 8/2011 Clark
2008/0141440 A1 6/2008 Taylor
2010/0064484 A1 3/2010 Clark
2013/0247433 A1* 9/2013 Le Devehat ..... A01K 11/001 40/302

* cited by examiner

*Primary Examiner* — Joanne Silbermann
(74) *Attorney, Agent, or Firm* — Albert Bordas, P.A.

(57) ABSTRACT

A pinned plate assembly having a plate assembly and post assemblies. The plate assembly mounts onto headgear without affecting the integrity of the headgear by utilizing existing eyelets to receive the post assemblies therethrough. The plate assembly is made of a flexible and bendable semi rigid material that maintains its shape once configured. The plate assembly has an exterior face, an interior face, first and second edges, first and second lateral edges, and an advertisement band section mounted onto the exterior face. The advertisement band section displays desired first text, and/or first letters, and/or first symbols, and/or first words, and/or first logo designs, and/or first artwork, and/or first graphics. The interior face has two apertures with respective aperture frames disposed at predetermined distances from respective corners defined by the first edge and the first and second lateral edges to receive the post assemblies.

13 Claims, 5 Drawing Sheets

PINNED PLATE ASSEMBLY

BACKGROUND OF THE INVENTION

1. Field of the Invention

The present invention relates to headgear accessories, and more particularly, to plate assemblies for headgear.

2. Description of the Related Art

Applicant believes that one of the closest references corresponds to U.S. Patent Application Publication No. 20080141440 A1, published on Jun. 19, 2008 to Taylor for Headgear with a Projected Design Element. However, it differs from the present invention because Taylor teaches embodiments for a headgear, such as a hat or visor, that includes a top portion, a sidewall extending downwardly from the top portion, and a design element attached to and spaced apart from the sidewall. The design element has a front surface and a back surface. The back surface of the design element is adjacent, spaced apart from, and co-facing the sidewall, and the front surface of the design element faces outwardly from the sidewall. The design element is spaced apart from the sidewall using one or more rods that project from the sidewall. The design element may comprise a logo, one or more letters, one or more words, or one or more numbers.

Applicant believes that another reference corresponds to U.S. Patent Application Publication No. 20100064484 A1, published on Mar. 18, 2010 to Clark, and corresponding U.S. Pat. No. 8,001,661 B2 issued on Aug. 23, 2011 for Apparatus for Securing Ornamentation to Personal Items. However, it differs from the present invention because Clark teaches an ornamental device that includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

Applicant believes that another reference corresponds to U.S. Pat. No. 7,640,636 B2 issued to Clark on Jan. 5, 2010 for Apparatus for Securing Ornamentation to Personal Items. However, it differs from the present invention because Clark teaches an ornamental device that includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

Applicant believes that another reference corresponds to U.S. Pat. No. 6,701,649 B1 issued to Brosi on Mar. 9, 2004 for Combat Identification Marker. However, it differs from the present invention because Brosi teaches a marker for attachment to a helmet head covering or the like of a friendly force member, and more particularly to an on-the-go hand securable marker having at least one extension with a retaining head for inserting into a hole in the uniform with the retaining head sufficiently rigid to prevent withdrawal therefrom under field conditions with the marker having a limited wavelength reflective surface thereon to enable a person observing under nighttime conditions to determine if a person is a friendly force member by the presence of reflections of electromagnetic radiation from the marker on the friendly force member. If field conditions change one can quickly remove the marker and replace the marker with conventional camouflage materials.

Applicant believes that another reference corresponds to U.S. Pat. No. 6,675,512 B1 issued to Shwartz, et al. on Jan. 13, 2004 for Display Assembly for Placement on Clothing Apparel. However, it differs from the present invention because Shwartz, et al. teaches a display assembly for placement on apparel. The assembly includes a flexible layer for placement against the apparel. The assembly further includes a display having pliable extension for penetrating across the flexible layer to securely position the display on the flexible layer. The assembly can be attached to the apparel, including a cap and visor by stitching or sewing the flexible layer to the apparel.

Applicant believes that another reference corresponds to U.S. Pat. No. 6,178,680 B1 issued to Sloot on Jan. 30, 2001 for Applique for Apparel and Method for Making the Applique. However, it differs from the present invention because Sloot teaches an applique and method for making it, wherein inner and outer vinyl sheets are welded together to form a decorative applique and wherein a pair of fastener are employed each having a flat segment that is embedded between the inner and outer vinyl sheets and has a stem that extends through the inner sheet, its outer located adhesive layer and overlying release liner. Caps are used to enable the applique to be affixed to a carrier card for shipment to an end user, who can then remove the caps and use the fasteners to affix the applique to apparel using the adhesive and re-use the fasteners. The combination of the adhesive and the fasteners enable a firm and sustaining attachment of the applique to surfaces having a low affinity to the adhesive employed on the inner layer.

Applicant believes that another reference corresponds to U.S. Pat. No. 6,122,805 A issued to Haegley on Sep. 26, 2000 for Device for Securing Ribbons to Military Uniform. However, it differs from the present invention because Haegley teaches a securing device to be located on the inside of a uniform garment to align and anchor military-type ribbon holders, nametags and warfare insignias. The securing device contains claps encased within a thin, soft, pliable plastic foam material sized slightly larger than the secured military-type ribbon holders, nametags and warfare insignias, yielding a flush appearance against the wearer's body. Repeated insertion to and retraction from my device can occur without concern for lost clasps or skin penetration.

Applicant believes that another reference corresponds to U.S. Pat. No. 3,735,447 A issued to Abraham on May 29, 1973 for Holder and Fastener. However, it differs from the present invention because Abraham teaches a device for holding an object and fastening same in a desired location. For example, the device may be used for securing a corsage or the like to an item of wearing apparel. The device includes a first element comprising a first body member adapted to have a corsage secured thereto and means defining a socket integrally connected to the first body member. The device further includes a second element comprising a second body member and fastener means in the form of pins projecting outwardly therefrom. When the device is used in conjunction with a corsage, the second element is adapted for disposition on the inside of the wearing apparel with the fastener pins adapted to pierce the wearing apparel and enter the socket of the first element to effect releasable engagement therebetween.

Applicant believes that another reference corresponds to U.S. Pat. No. D558,955 S issued to Taylor on Jan. 8, 2008 for Head Gear with Projecting Indicia. However, it differs from the present invention because Taylor teaches an ornamental design for a head gear with projecting indicia that is different from Applicant's invention.

Applicant believes that another reference corresponds to U.S. Pat. No. D603,584 S issued to Porter on Nov. 10, 2009 for Headwear Device. However, it differs from the present invention because Porter teaches an ornamental design for a headwear device that is different from Applicant's invention.

Applicant believes that another reference corresponds to PCT Publication No. WO 2005120266 A1 published by WIPO to Thompson on Dec. 22, 2005 to Taylor for Instant Wearable Cap Bill Shaper with Indicia. However, it differs from the present invention because Thompson teaches a curved cap bill shaper (20, 20A, 20B) that has binding tabs (15), snaps (30), spikes (46), or adjustable snaps (36) at each end binding the side edges of a cap bill (18) to the bill shaper and imparting a desired curvature to the cap bill. Mating curved arms (8B, 9B) hinged to the bill shaper may adjustably interlock below the cap bill sandwiching it therebetween. Protruding points (14, 46) from the bill shaper and the arms may pierce or indent the cap bill. Indicia (44) may be placed on a top surface (21) of the bill shaper which covers or partly covers the cap bill.

Other patents describing the closest subject matter provide for a number of more or less complicated features that fail to solve the problem in an efficient and economical way. None of these patents suggest the novel features of the present invention.

SUMMARY OF THE INVENTION

The present invention is a pinned plate assembly, comprising a plate assembly made of a flexible and bendable semi rigid material that maintains its shape once configured. The plate assembly has an exterior face, an interior face, first and second edges, first and second lateral edges, and an advertisement band section mounted onto the exterior face. The advertisement band section displays desired first text, and/or first letters, and/or first symbols, and/or first words, and/or first logo designs, and/or first artwork, and/or first graphics. The interior face has two apertures with respective aperture frames disposed at predetermined distances from respective corners defined by the first edge and the first and second lateral edges.

The advertising band section is an integral part of the plate assembly, or is a separate band that is attached to the exterior face. As a separate band, the advertising band section is attached to the exterior face with removable/detachable means including hook and loop fasteners, magnets, silicone, and non-permanent glue or adhesives. The aperture frame is fixed onto the interior face around its respective aperture. Each aperture frame has a first diameter slightly smaller than a second diameter of the aperture. The interior face comprises a reusable interior identification section, wherein personal dedications, and/or identification information, and/or emergency contact information, and/or special or medical conditions, and/or desired second text, and/or second letters, and/or second symbols, and/or second words, and/or second logo designs, and/or second artwork, and/or second graphics may be placed thereon. The plate assembly may be of a rectangular shape.

Further comprising two post assemblies that removably mount onto the interior face. Each of the two post assemblies comprises a backing. Extending from the backing is a swivel base. Protruding from the swivel base is a post having a head at its distal end. The swivel base comprises swivel means to accommodate different headgear dimensions, whereby the post swivels a predetermined amount as it extends from the swivel base.

Each of the two apertures is of a cooperative shape and dimension to removably receive a respective head of the post therein. Each of the respective aperture frames is made of a resilient material that permits a respective the head to fit therein. The swivel base permits the post to swivel from a perpendicular position with respect to the backing to a predetermined angled position. Positions of the two apertures are intended to coincide or complement a placement of eyelets in headgear. The plate assembly mounts onto the headgear without affecting integrity of the headgear by utilizing existing eyelets to receive the two post assemblies therethrough. The plate assembly mounts onto headgear when the two apertures are aligned with eyelets and from an interior section of the headgear crown, the two post assemblies pass through the eyelets until the two apertures receive their respective head. Each swivel base accommodates to the headgear having eyelets of different dimensions, and distances from each other. In a preferred embodiment, the headgear is a soft cap with a rounded crown and a stiff peak projecting in front.

It is therefore one of the main objects of the present invention to provide a pinned plate assembly to mount onto headgear for customization.

It is another object of the present invention to provide a pinned plate assembly that mounts onto headgear without affecting the headgear's integrity by utilizing existing headgear eyelets to receive post assemblies therethrough.

It is another object of the present invention to provide a pinned plate assembly that comprises a plate assembly and a post assembly.

It is another object of the present invention to provide a pinned plate assembly that comprises a reusable advertisement band section to display desired text, and/or letters, and/or symbols, and/or words, and/or logo designs, and/or artwork, and/or graphics for headgear customization.

It is another object of the present invention to provide a pinned plate assembly that comprises reusable advertisement band section that is removably or permanently mounted onto the plate assembly.

It is another object of the present invention to provide a pinned plate assembly comprising a reusable interior identification section, wherein a user may write, print, or otherwise place thereon personal dedications, and/or identification information, and/or emergency contact information, and/or special or medical conditions, and/or desired text, and/or letters, and/or symbols, and/or words, and/or logo designs, and/or artwork, and/or graphics.

It is another object of the present invention to provide a pinned plate assembly comprising post assemblies having swivel means to accommodate different headgear dimensions.

It is another object of the present invention to provide a pinned plate assembly that is volumetrically efficient for carrying, transporting, and storage.

It is another object of the present invention to provide a pinned plate assembly that can be readily assembled and disassembled without the need of any special tools.

It is another object of the present invention to provide a pinned plate assembly that is of a durable and reliable construction.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
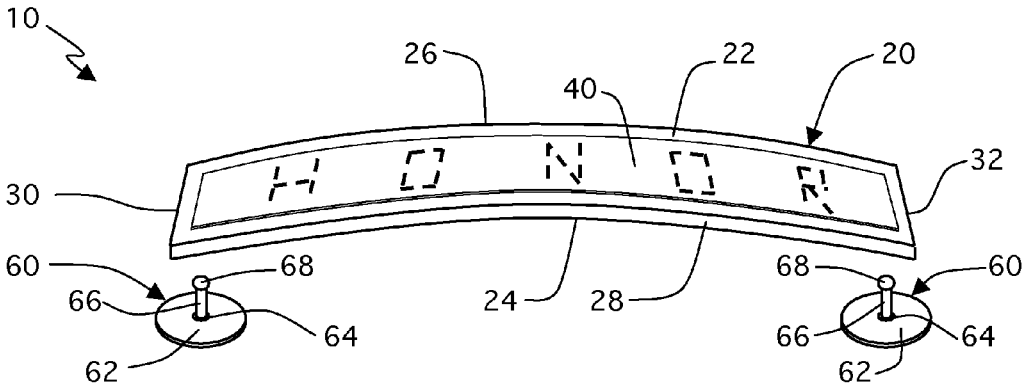
FIG. 1 represents a top isometric view of the present invention disassembled.

Referring now to the drawings, the present invention is a pinned plate assembly and is generally referred to with numeral 10. It can be observed that it basically includes plate assembly 20 and post assemblies 60.

Figure 2:
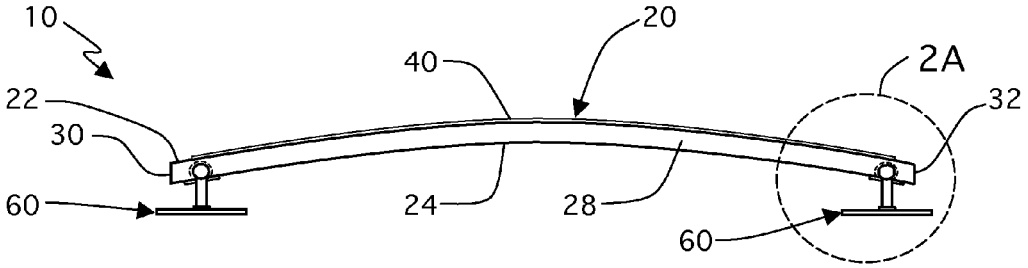
FIG. 2 is a front elevational view of the present invention assembled.

As seen in FIGS. 1 and 2, in a preferred embodiment plate assembly 20 has a substantially rectangular shape. Plate assembly 20 has exterior face 22, interior face 24, edges 26 and 28, and lateral edges 30 and 32. Advertisement band section 40 is mounted onto exterior face 22.

Figure 2A:
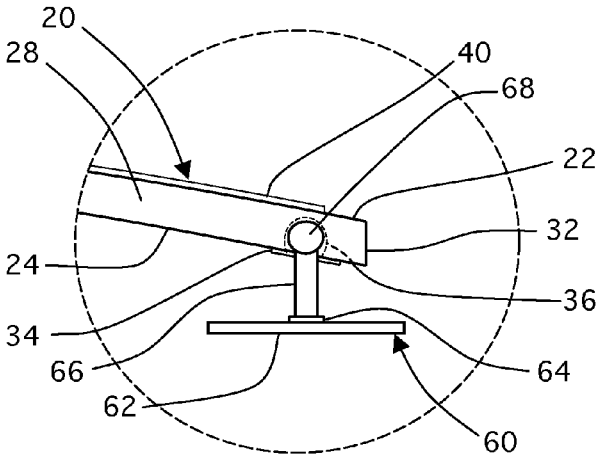
FIG. 2A is an enlarged view of a portion of the present invention taken along line 2A from FIG. 2.
Figure 2B:
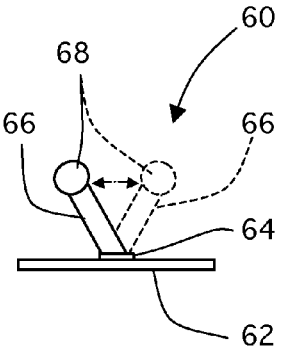
FIG. 2B is a front elevational view of a post assembly and its swivel means.

As seen in FIGS. 2A and 2B, post assemblies 60 removably mount onto interior face 24. Each post assembly 60 comprises backing 62. Extending from backing 62 is swivel base 64. Protruding from swivel base 64 is post 66 having head 68 at its distal end. Swivel base 64 comprises swivel means to accommodate different headgear H dimensions, whereby post 66 swivels a predetermined amount as it extends from swivel base 64.

As seen in FIG. 2A, interior face 24 has at least one aperture frame 34 having a respective aperture 36. Aperture 36 is of a cooperative shape and dimension to removably receive head 68 of post 66 therein.

As seen in FIG. 2B, swivel base 64 permits post 66 to swivel from a perpendicular position with respect to backing 62 to a predetermined angled position as illustrated.

Figure 3:
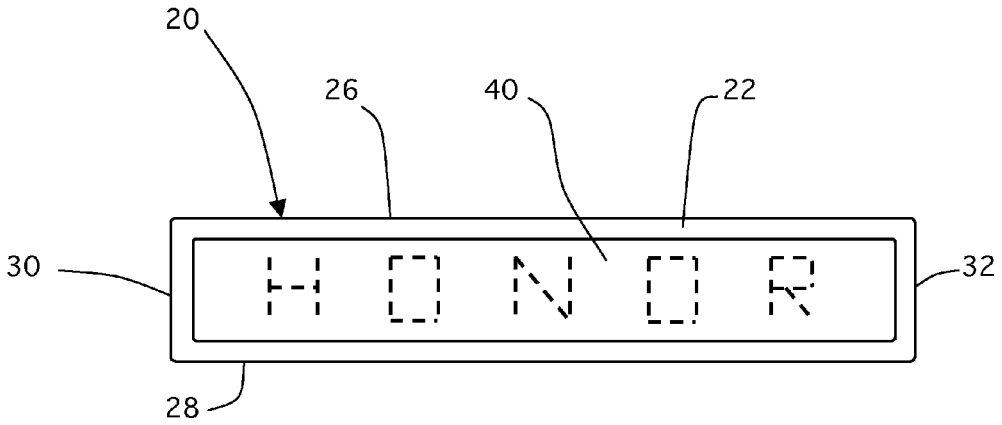
FIG. 3 is a top view of a plate assembly.
Figure 5A:
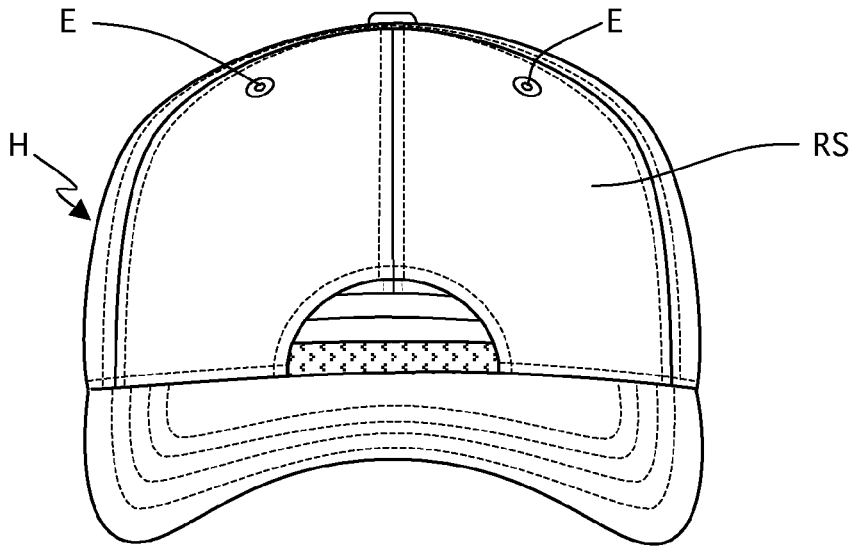
FIG. 5A is a first rear view of a headgear comprising eyelets.
Figure 5B:
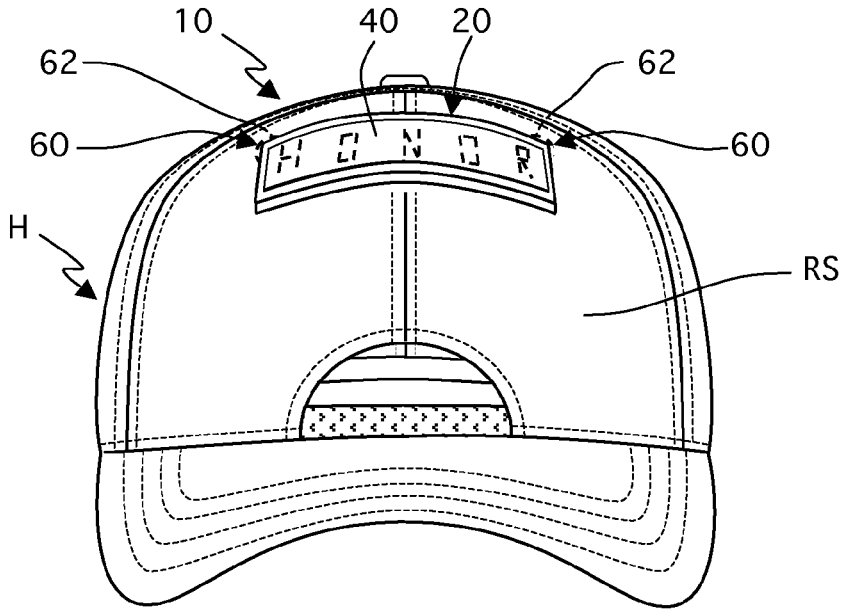
FIG. 5B is a second rear view of the headgear with the present invention mounted thereon.

As seen in FIG. 3, advertisement band section 40 displays desired text, and/or letters, and/or symbols, and/or words, and/or logo designs, and/or artwork, and/or graphics for headgear H customization, seen in FIG. 5B. Advertising band section 40 is an integral part of plate assembly 20, or a separate band that is attached to exterior face 22. As a separate band, advertising band section 40 may be attached to exterior face 22 with removable/detachable means such as hook and loop fasteners, magnets, silicone, and non-permanent glue or adhesives.

Figure 4:
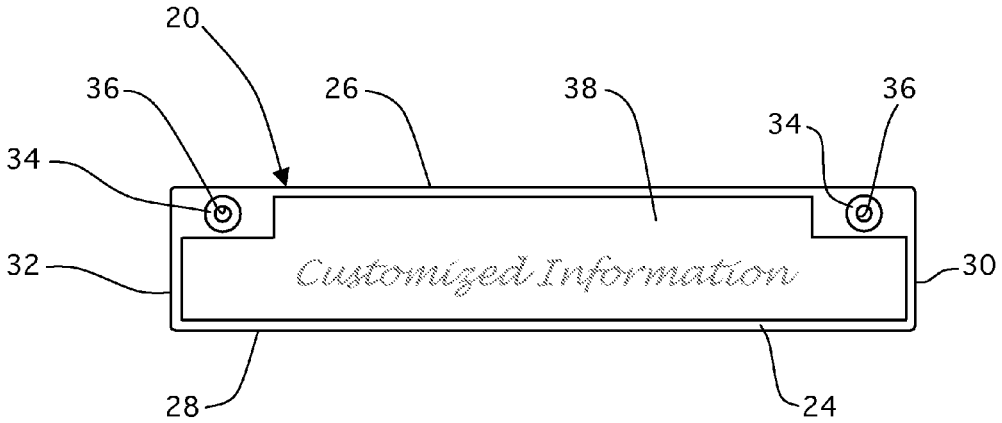
FIG. 4 is a bottom view of the plate assembly.

As seen in FIG. 4, in a preferred embodiment, interior face 24 has two apertures 36 with respective aperture frames 34, disposed at predetermined distances from respective corners defined by edge 26 with lateral edge 30, and edge 26 with lateral edge 32. In a preferred embodiment, the position of apertures 36 are intended to coincide, or complement the placement of eyelets E in headgear H, as seen in FIGS. 5A, 5B, 6A, and 6B. Aperture frame 34 is fixed onto interior face 24 around aperture 36. Aperture frame 34 has a first diameter slightly smaller than a second diameter of aperture 36 and head 68. However, aperture frame 34 is made of a resilient material that permits head 68 to fit therein when a user applies a force of a predetermine magnitude.

Interior face 24 comprises interior identification section 38. In a preferred embodiment, interior identification section 38 is reusable, wherein a user may write, print, or otherwise place thereon personal dedications, and/or identification information, and/or emergency contact information, and/or special or medical conditions, and/or desired text, and/or letters, and/or symbols, and/or words, and/or logo designs, and/or artwork, and/or graphics.

As seen in FIGS. 5A and 5B, headgear H comprises rear section RS having eyelets E. In a preferred embodiment, present invention 10 mounts onto headgear H without affecting the headgear's H integrity by utilizing existing eyelets E to receive post assemblies 60 therethrough.

As best seen in FIG. 5B, present invention 10 is mounted onto rear section RS of headgear H, whereby apertures 36 are aligned with eyelets E and from an interior section of the headgear H crown, posts 66 pass through eyelets E until each aperture 36 receives its respective head 68. It is noted that a predetermined force is required for aperture 36 to receive head 68. Swivel bases 64 accommodate to various styles of headgear H having eyelets E of different dimensions, and distances from each other.

Figure 6A:
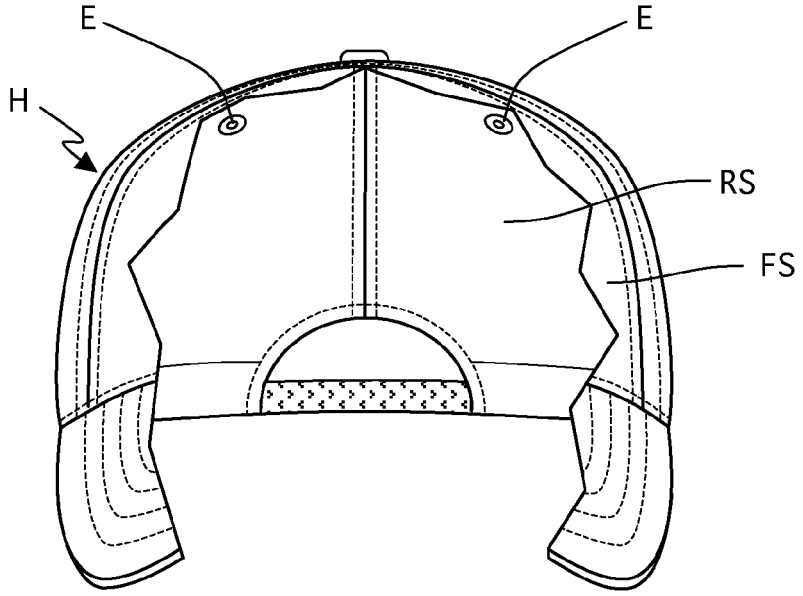
FIG. 6A is a first front view of the headgear partially cross-sectioned to show an interior section of the headgear crown.
Figure 6B:
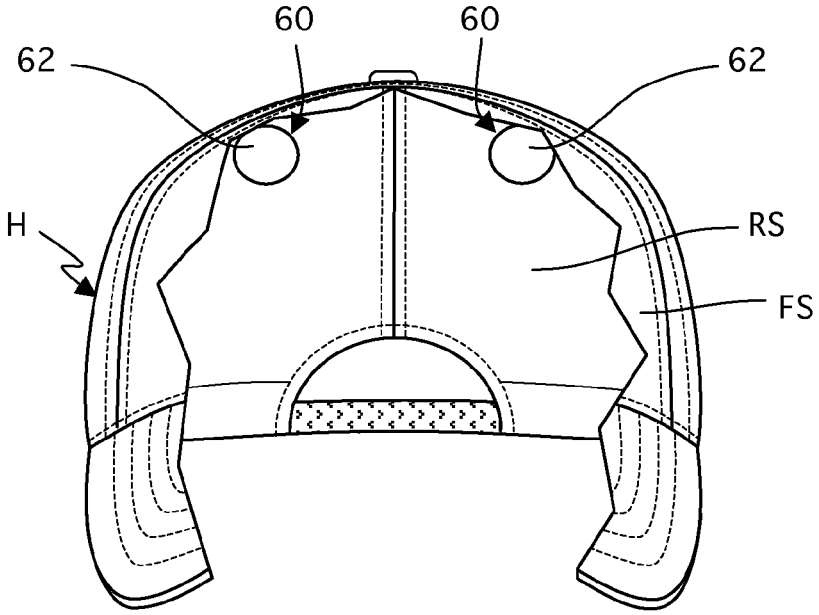
FIG. 6B is a second front view of the headgear partially cross-sectioned to show the interior section of the headgear crown and the present invention mounted thereon.

As seen in FIGS. 6A and 6B, headgear H also has front section FS. Present invention 10 may be mounted onto any section of headgear H having eyelets E. In addition, swivel bases 64 function to provide optimum comfort to the wearer since backings 62 will accommodate themselves to the shape of the wearer's head, as best seen in FIG. 6B.

In a preferred embodiment, headgear H is a baseball styled cap defined as a type of soft cap with a rounded crown and a stiff peak projecting in front. The front of the cap typically contains designs or logos of sports teams, namely baseball teams, or names of relevant companies, when used as a commercial marketing technique. The back of the cap may be "fitted" to the wearer's head size or it may have a plastic, "VELCRO", or elastic adjuster so that it can be quickly adjusted to fit different wearers. The baseball cap is a part of the traditional baseball uniform worn by players, with the brim pointing forward to shield the eyes from the sun. The cap is also often seen in everyday casual wear.

Figure 7:
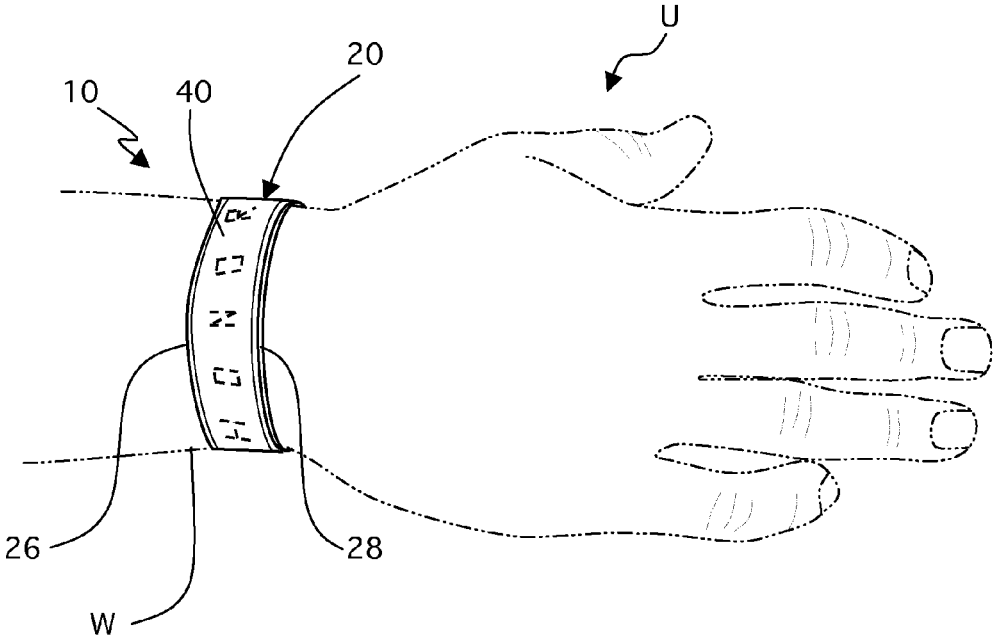
FIG. 7 is top view of the present invention worn in a bracelet configuration.

As seen in FIG. 7, plate assembly 20 is worn in a bracelet configuration on wrist W of user U, whereby plate assembly 20 is made of a flexible and bendable semi rigid material that maintains its shape once configured. Plate assembly 20 may also be attached or mounted onto brief cases, purses, luggage, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pinned plate assembly, comprising:

A) a plate assembly made of a flexible and bendable semi rigid material that maintains its shape once configured, said plate assembly has an exterior face, an interior face, first and second edges, first and second lateral edges, and an advertisement band section mounted onto said exterior face, said advertisement band section displays desired first text, or first letters, or first symbols, or first words, or first logo designs, or first artwork, or first graphics, said interior face has two apertures with respective aperture frames disposed at predetermined distances from respective corners defined by said first edge and said first and second lateral edges; and B) two post assemblies, said plate assembly mounts onto a headgear without affecting integrity of said headgear by utilizing existing eyelets to receive said two post assemblies therethrough, whereby said two post assemblies mount onto said interior face.

2. The pinned plate assembly set forth in claim 1, further characterized in that said advertising band section is an integral part of said plate assembly, or is a separate band that is attached to said exterior face.

3. The pinned plate assembly set forth in claim 2, further characterized in that as said separate band, said advertising band section is attached to said exterior face with hook and loop fasteners, magnets, silicone, and non-permanent glue or adhesives.

4. The pinned plate assembly set forth in claim 1, further characterized in that each said aperture frame is fixed onto said interior face around its respective said aperture.

5. The pinned plate assembly set forth in claim 1, further characterized in that each said aperture frame has a first diameter slightly smaller than a second diameter of said aperture.

6. The pinned plate assembly set forth in claim 1, further characterized in that said interior face comprises a reusable interior identification section, wherein personal dedications, or identification information, or emergency contact information, or special or medical conditions, or desired second text, or second letters, or second symbols, or second words, or second logo designs, or second artwork, or second graphics may be placed thereon.

7. The pinned plate assembly set forth in claim 1, further characterized in that said plate assembly has a substantially rectangular shape.

8. The pinned plate assembly set forth in claim 1, further characterized in that each of said two post assemblies comprises a backing, extending from said backing is a swivel base, protruding from said swivel base is a post having a head at its distal end.

9. The pinned plate assembly set forth in claim 8, further characterized in that each of said two apertures is of a cooperative shape and dimension to removably receive a respective said head of said post therein.

10. The pinned plate assembly set forth in claim 8, further characterized in that each of said respective aperture frames are made of a resilient material that permits a respective said head to fit therein.

11. The pinned plate assembly set forth in claim 8, further characterized in that said swivel base permits said post to swivel from a perpendicular position with respect to said backing to a predetermined angled position.

12. The pinned plate assembly set forth in claim 8, further characterized in that said plate assembly mounts onto headgear having a crown, when said two apertures are aligned with eyelets and from an interior section of said crown, said two post assemblies pass through said eyelets until said two apertures receive their respective said head.

13. The pinned plate assembly set forth in claim 12, further characterized in that said headgear is a soft cap with a rounded crown and a stiff peak projecting in front.

* * * * *